US006138530A

United States Patent [19]

McClure

[11] Patent Number: 6,138,530

[45] Date of Patent: Oct. 31, 2000

[54] LOCKING COLLAR REMOVAL TOOL

[76] Inventor: Travis McClure, 429 - 9th Ave., Kirkland, Wash. 98033

[21] Appl. No.: 09/378,229

[22] Filed: Aug. 19, 1999

Related U.S. Application Data

[60] Provisional application No. 60/100,068, Sep. 12, 1998.

[51] Int. Cl.[7] ..... B25B 13/32

[52] U.S. Cl. ..... 81/58; 81/90.2; 81/90.3

[58] Field of Search ..... 81/58, 58.1, 121.1, 81/124.6, 125, 90.2, 90.3

[56] References Cited

U.S. PATENT DOCUMENTS 5,207,130 5/1993 Payne ..... 81/90.2

6,000,300 12/1999 Plamondon ..... 81/90.2

*Primary Examiner*—David A. Scherbel

*Assistant Examiner*—Anthony Ojini

[57] ABSTRACT

A tool to remove a locked collar locked to the threaded shaft of a frangible fastener, having a collet with gripping means and inner grasping teeth has a segment removed to permit the collet to decrease in size. An outer cylinder with inner threads are sloped contrary to the threads locking the collar to the fastener shaft and a bottom inner tapered portion. An inner cylinder with matching threads and torquing means is torqued with respect to the outer cylinder to translate within the outer cylinder, urging the collet within into inner beveled portion of the outer cylinder thereby closing the collet to surround and grasp the locked collar. While the shaft of the fastener is held, further torquing imparts rotational force to the collar in an opening direction.

10 Claims, 6 Drawing Sheets

LOCKING COLLAR REMOVAL TOOL

The inventor claims benefit of the provisional co-pending patent application entitled LOCKING COLLAR REMOVAL TOOL, filed on Sep. 12, 1998, application No. 60/100,068.

BACKGROUND OF THE INVENTION

1. Field of the Invention

The present invention relates generally to metal working tools used to remove fasteners and more specifically to tools used to remove locking collar fasteners.

2. Description of the Related Art

A locking collar fastener system, sometimes called a frangible fastener or "HI-LOK" is used in environments of high vibration, such as on aircraft. The locking collar fastener system is used wherever a rivet can be used to join parts together.

The frangible fastener system utilizes a first piece comprising a threaded shaft on one end and an exposed retaining ring at the other end. A passage is drilled through the parts to be fastened, typically large sheets of metal, such as aircraft surfaces and boats. The threaded shaft portion of the fastener is inserted through the aligned passages to the exposed retaining ring. Often the surface of the part to be fastened is indented at the hole consistent with the retaining ring to provide a flat outer surface at the area of the retainer ring. A matching threaded locking collar is hand rotated upon the threaded portion of the shaft, then controllably torqued with a wrench. The threaded locking collar joins to a wrenching ring by a notched neck which shears from the collar at a predetermined torsional loading during the torquing. The threaded locking collar having an upset portion, usually a slightly elliptical shape provides a frictional spring lock to prevent the locking collar from untreading or loosening, even in environment of high vibration and stress. The collar remains locked to the fastener shaft even when the residual tension on the fastener is lost. Exposed on each side of the parts obscuring the passage, on one side is the outer portion of the retaining ring that may be recessed and on the other side, the almost round locking collar.

The Problem of Removal

The removal of the HI LOK and other frangible fasteners without damage to the part attached often presents a challenging problem but is needed for many useful reasons. nO the HI LOK type frangible fastener, an hexagonal opening at the end of the shaft of the locking collar fastener is sufficiently recessed in depth to receive a standard allen wrench for the purpose of retaining the shaft in position with respect to the locking collar during removal.

The removal of the locked collar from the shaft is usually difficult, but necessary for repair and maintenance of the joined parts. To accomplish this, heretofore, drilling means such as a drill bit manual, electric or air-motor are used to drill out the center of the shaft portion or a cutting means such as a hack-saw is used to cut the collar. In either case, this activity weakens the fastener. Then the parts of the collar are pried, chiseled or twisted off to expose the shaft portion of the fastener within the passage. Then a knock-out pin is used to force the shaft from the passage. The problem with this method is the time it takes to drill or cut and manipulate the collar in order to expose then remove the shaft from the passage. Furthermore, scars from the removal operations and consequential weakening to the parts surrounding the passage may create problems in refastening the parts using the same passage.

Ongoing efforts have been made to improve the means to remove these types of fasteners without causing damage. Such efforts have been addressed both to the general object of improving the manner of removal of the frangible fasteners as well as the speed that these fasteners may be removed without damage to the parts fastened. Because the frangible fasteners are designed to hold parts together under environments of extreme stress and vibration, until my invention no practical, universally adaptable tool was known to address the removal of frangible fasteners.

BRIEF SUMMARY OF THE INVENTION

My tool is designed to grasp the almost round collar then rotate it with respect to a shaft portion of the fastener until the collar disengages. The tool comprises an outer cylinder having a lower inner tapered section and an upper inner threaded portion, the taper section portion of the cylinder having a smaller diameter then the upper inner threaded portion of the outer cylinder. The inner cylinder is torqued with respect to the outer cylinder to turn the tool in the direction that will loosen the collar from the fastener. An inner cylinder having an circular lower portion and an upper outer threaded portion matching the upper inner threaded portion of the other cylinder translates movement of the inner cylinder within the outer cylinder, tapered within. A collet comprising a semi-cylindrical harden metal piece located at the bottom rim of the inner cylinder within the tool translates the movement of the inner cylinder with respect to the outer by moving through the bottom inner tapered section of the outer cylinder, to close. When the tool is in place, the collet seats to surround the collar, the torquing movement compresses the collet to surround and then compress the circumference of the collar, the collet locking onto the collar. Further torquing of the inner cylinder translates the torque tangentially to the collar to turn only the collar with respect to the shaft portion of the fastener. Teeth oriented within the collet further grasp the collar to prevent slippage. Outside stirations or indentations oriented parallel to the center axis of the collet along the outer service of the collet may be used to assist the collet to flex as it surrounds the collar.

These features allow for a very short collet with a longitudinal slot along the entire length of the collet so that my tool can be short and squat to fit into any area that a locking collar is used. Furthermore, my tool provides a collet that flexes laterally instead of the longitudinally flexing teeth of other tools. This useful feature of my invention eliminates jamming and the use of spring loaded disks and knock-out pins of some other tools. With my invention, the collet is urged towards a taper area to pull the tool away from the fastened parts, instead of being pulled torward the fastened parts as other devices work.

Accordingly, it is a general object of the present invention to provide a tool designed to remove frangible fasteners without damage to the parts fastened.

More specifically, it is an object of the present invention to provide a means to torque the collar of the fastener with respect to the shaft portion of the fastener without cutting, bending or deforming the fastener.

It is also an object to provide a tool that is small, can be conveniently stored when not in use, can be used with commonly available tools such as standard socket wrenches, allen wrenches and the like.

It is another object of the present invention to attain the foregoing objects and also to provide an improved means to quickly remove a frangible fastener without need to use power tools, such as electric or air hammers, electric torquing means and the like using a compact unit that can be used many times without damage to the underlying parts.

Further objects and advantages of my invention will become apparent from a consideration of the drawings and ensuing description thereof.

DESCRIPTION OF THE PREFERRED EMBODIMENTS

Figure 1:
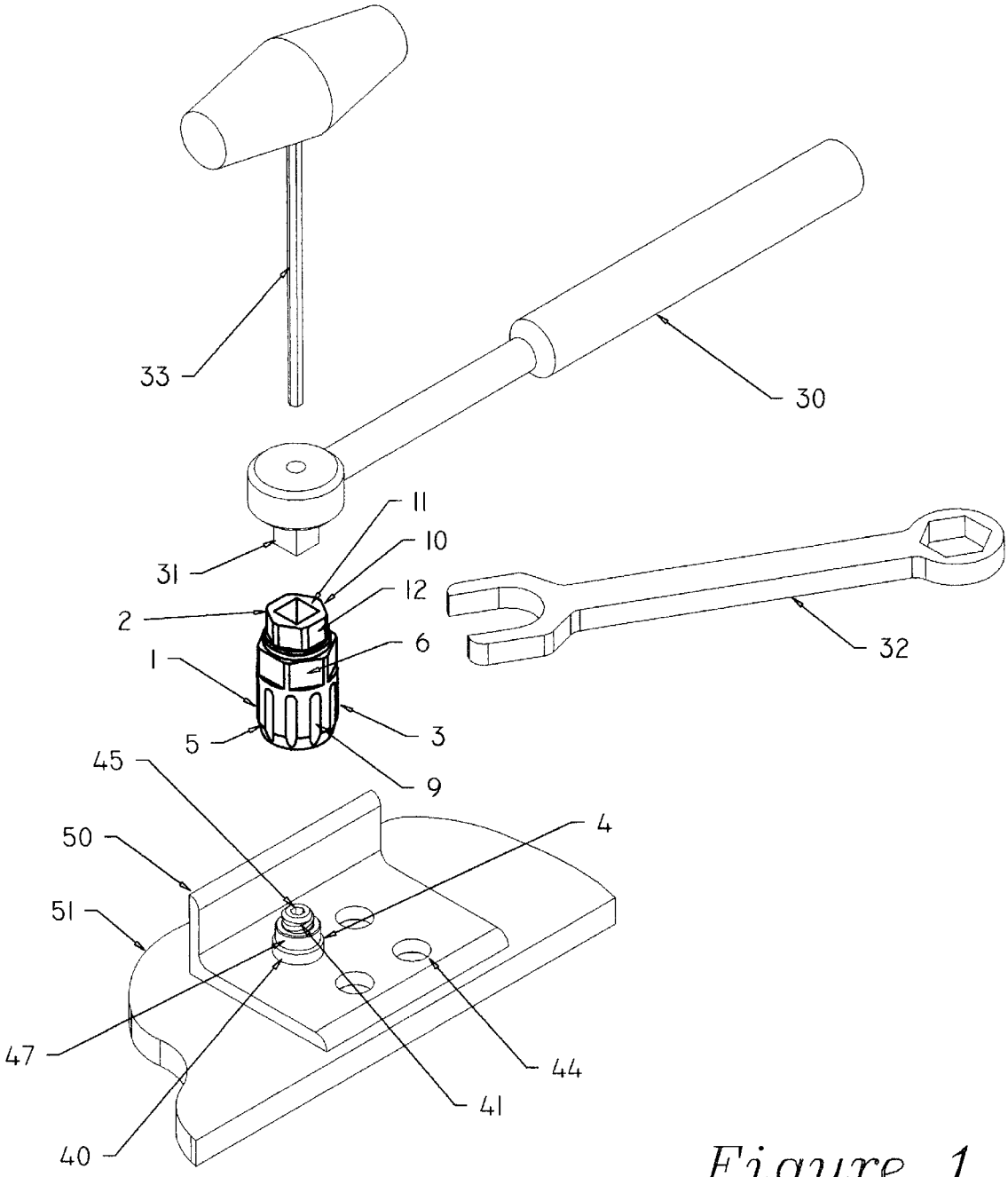
FIG. 1 is a perspective drawing of my removal tool in relationship to a frangible fastener, with other tools used with the removal tool.

Referring to FIG. 1, my locking collar removal tool 1 features a recess 11 to receive a standard rachet or wrench prong 31 of a rachet wrench 30 or similar levered tool outlined in this FIG. 1 and a set of standard hexagonal faces 12 around the circumference of the head 10 portion of the inner cylinder 2 to receive a standard open or closed head wrench 32. The head 10 of the inner cylinder 2 of the removal tool is conveniently torqued with either wrench 30 or 32.

The typical HI LOK or collar fastener 4 has a shaft 42 with a recess 45 for hexagonal shaped allen wrenches 33 at a collar end. The length of the shaft could be of various lengths depending on the thickness of the parts 50 and 51 joined. The fastener system comprises a threaded portion 41 of the shaft 42, a collar 40, a retaining ring 43 and a locking upset portion 47 tapered at 27 to a bottom portion 48. The retaining ring 43 may have a beveled other end to permit the head of the retaining ring 43 to fit smoothly along the surface of part 51.

Figure 5:
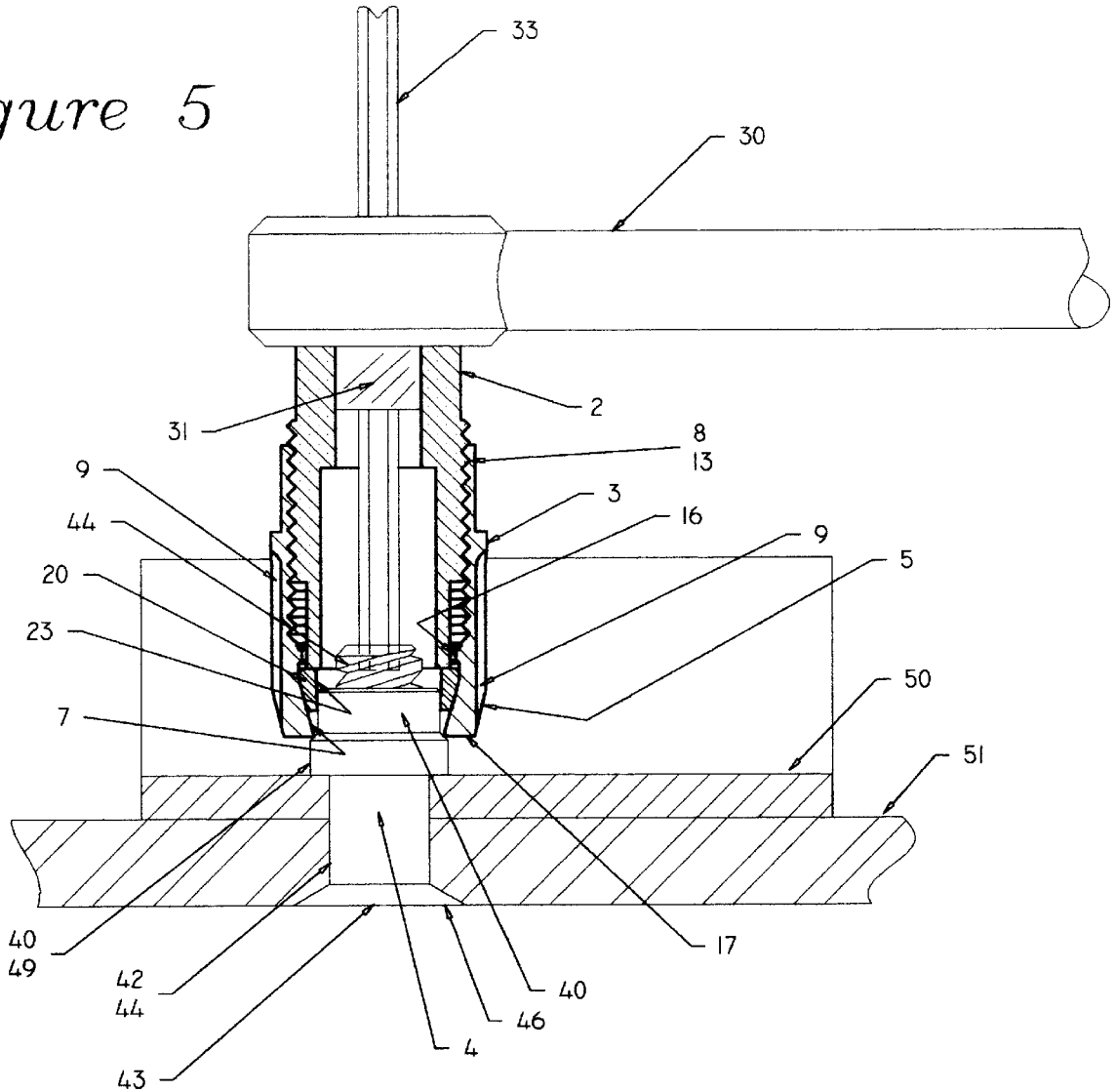
FIG. 5 is a side cross sectional view of my invention in use.

The parts 50 and 51 were fastened by placing the shaft 42 of fastener 4 within aligned passages 44, the shaft 42 inserted through up to the retainer ring 43 at the end of the fastener 4. FIG. 5 shows the surface 51 cut away to permit the beveled portion of the fastener retaing ring to seat therein. A locking collar 40 with wrenching ring (not shown) was then torque on the threaded portion of the shaft, the collar 40 moving along the threaded portion of the shaft to the part 50. Further torquing then compressed part 50 to 51 to a predetermined shear torquing load that breaks the wrenching ring portion (not shown) from the collar, somewhat distorting the collar 40 leaving an upset portion 47 but resulting in a very strong fastener 4 holding the parts 50 and 51, with only the collar 40 and upset portion 47 exposed.

Figure 2:
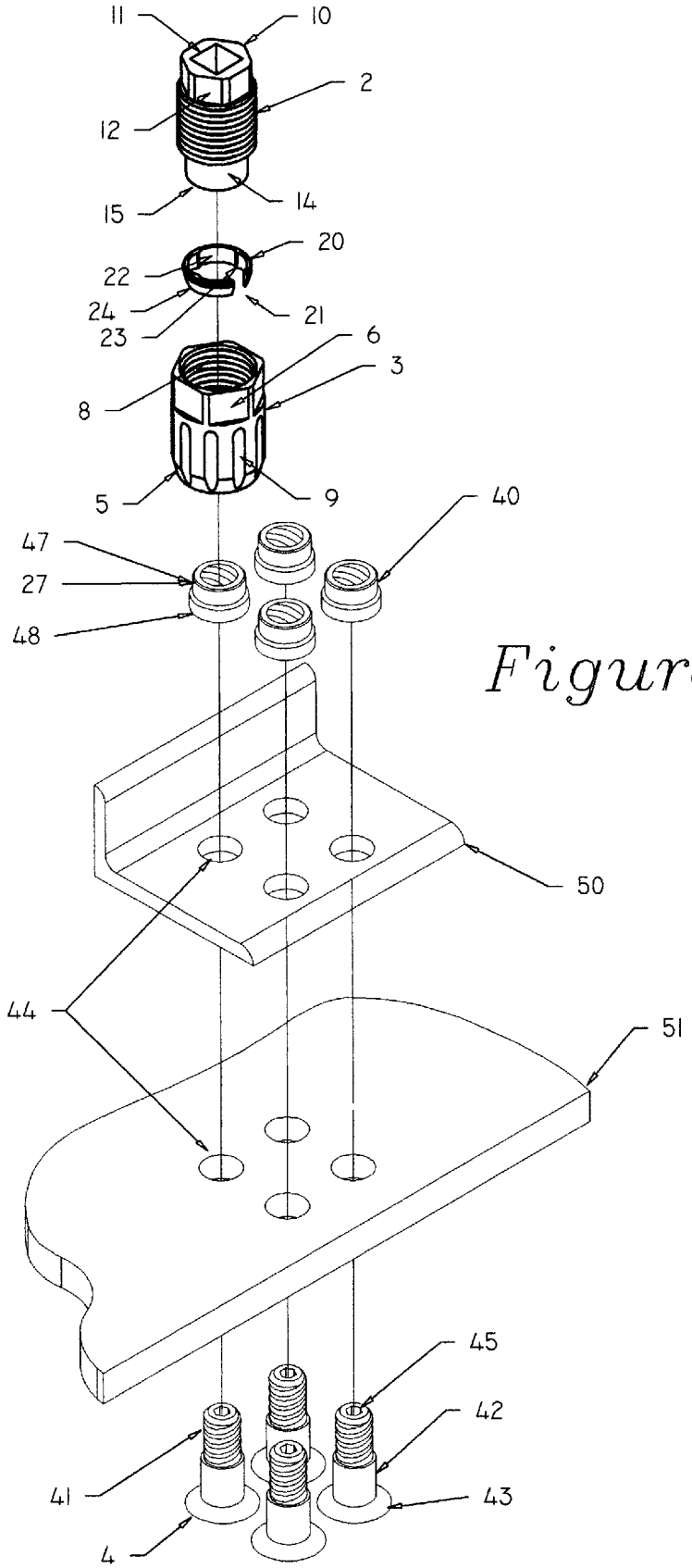
FIG. 2 is a perspective illustration of my removal tool detailing the parts thereof and the parts of the frangible fastener.
Figure 3:
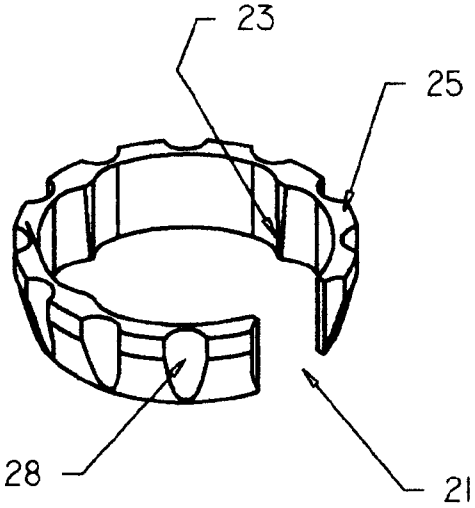
FIG. 3 is a perspective view of the collet.
Figure 7:
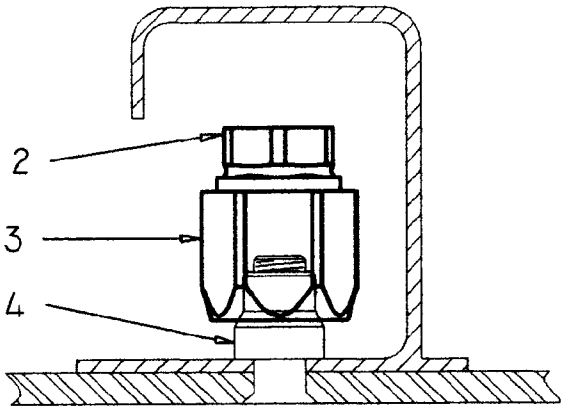
FIG. 7 shows a version of my tool to be used in areas of limited access.
Figure 4:
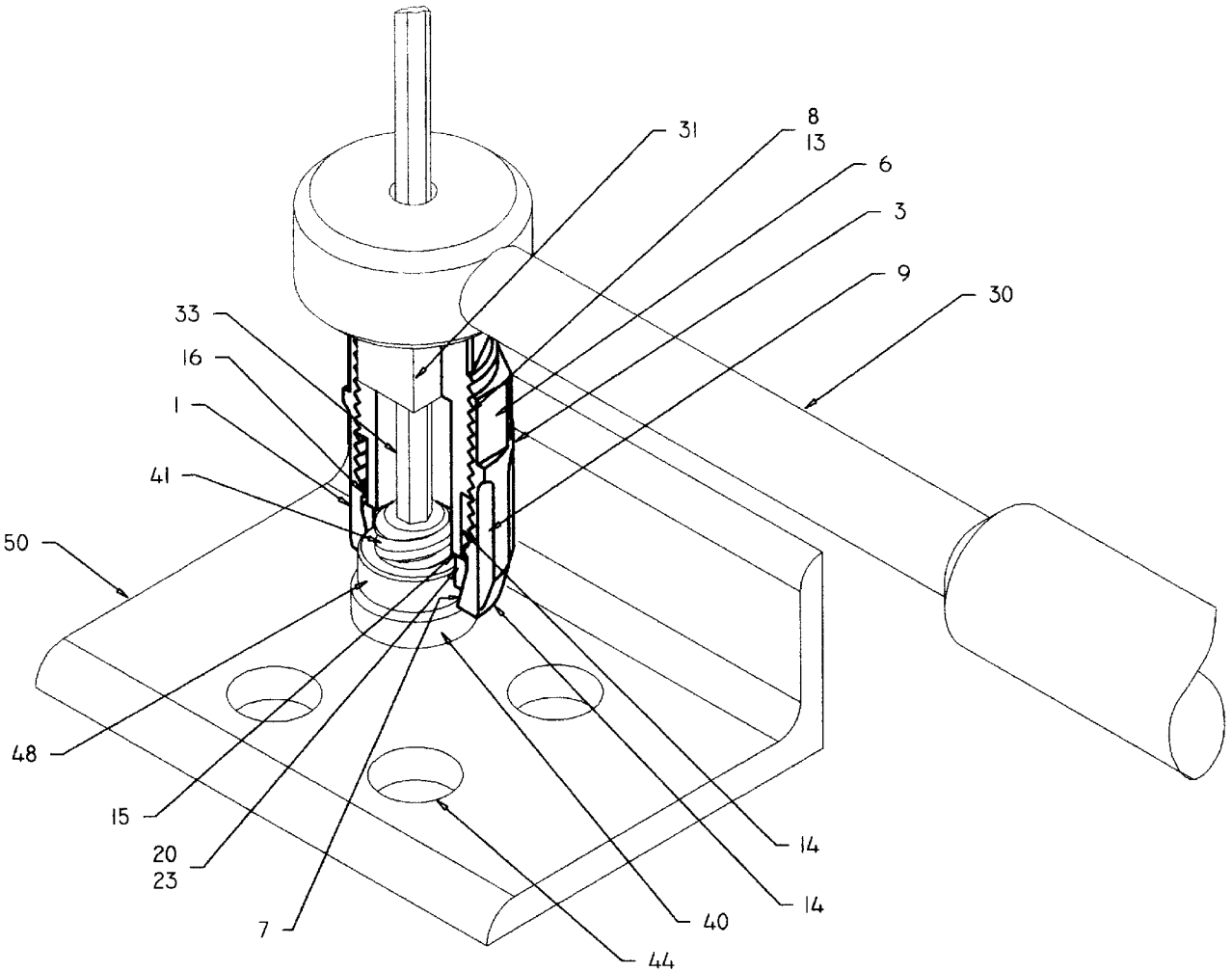
FIG. 4 is a partial perspective illustration of my removal tool in use.

Refering to FIG. 2, counter-wise outer threads 13 on the mid-portion of the inner cylinder 2 match counter-wise inner threads 8 of the outer cylinder 3, the cylinders sized so that the inner cylinder 2 can be threaded by rotation within the outer cylinder 3. The counter-wise direction of the threads refers to the direction of the slope of the threads for the fastener 4 to be opened. For example, if the fastener joins part 50 and 51 by a clockwise rotation of the collar 40 along shaft 42 interacting with threads 41 to lock the collar, then the counter-wise outer threads 13 would be counter-clock wise, that is in the opposite direction. This provides the tendency to unlock the collar at the time the tool is used, as will be described in the fullest details below. If the tool's threads 13 and 8 were in the same direction as the fastener's threads 41, there would be a tendency to tighten the fastener 4 instead of unlocking the fastener 4. While the outer gripping grooves 9 are generally useful, in order to contruct a squat version of my tool 1, these may be eliminated. For example, FIG. 7 shows a squat version of my invention with the surface groves 9 missing, yet the outer cylinder 3 can be grasped by an open end wrench 32 while the inner cylinder 2 is torqued using another open end wrench.

Figure 6:
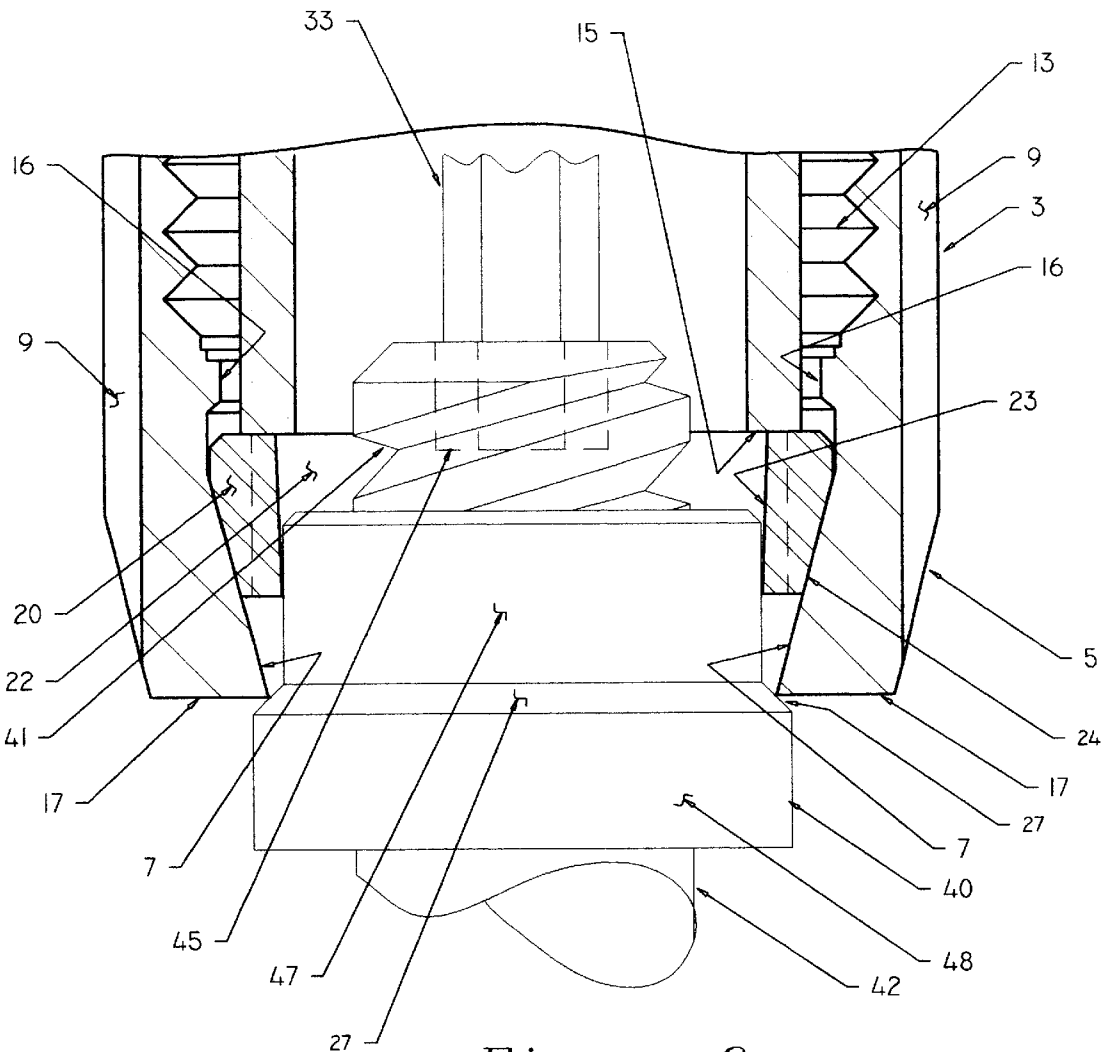
FIG. 6 is a magified illustration of my removal tool in conjunction with the frangible fastener.

The outer cylinder shown generally as 3 having a set of standard hexagonal faces 6 form the outer circumference of the top portion of the outer cylinder to receive a standard open or closed head wrench such as 32. Outer gripping groves 9 form the outer circumference of the of bottom portion of the outer cylinder. The hexagonal faces 6 and gripping groves 9 assists staying the outer cylinder 3 during the initial portion of the removal procedure and to assist the threading of inner cylinder 2 within the outer cylinder 3. The circumferential outer bottom edge 5 of the outer cylinder 3 tapered inward from the surface of the outer cylinder to the bottom rim 17 of the outer cylinder 3 to include a portion of the outer gripping groves 9. The circumferential inner bottom edge 7 (best viewed in FIG. 6) also tapers inward for a portion of the of the outer cylinder 3 to a size smaller than the outside diameter of the collar 40. The tapered portion 27 stops the removal tool 1 from directly contacting surface 50.

The smooth, lower portion area 14 of the inner cylinder 2 extending from the threads 13 terminates to flat bottom rim 15. The diameter of the lower portion area 14 of the inner cylinder 2 is sized to impress upon a flat top rim 25, of a nearly circular collet 20 made of hardened material capable of a memory such as spring steel to permit the collet 20 to return to its original shape after deformation. This eases release of the collar after removal from the fastener. The collet has a outer tapered bottom rim 24 and inner griping teeth 23 raised inward from the inner surface 22 of the collet 20. A gap 21 in the nearly circular configuration of the collet 20 permits the collet to decrease in diameter when urged by the bottom rim 15. Outer linear recesses, or flexibility indentations 28 along collet surface asists the harden material composing the collet to flex as it surrounds the collar 47. As the inner cylinder is turned counter-wise within the outer cylinder 3, the inner cylinder forces the collet 20 to move through the inner tapered bottom portion 7 of the outer cylinder 3 to close the gap 21 making the collet 20 smaller in diameter and to surround the upset portion 47.

To operate, the tool 1 is placed verically above the fastener to be removed, bottom rim 17 placed to surround the upset portion 47 of the locked collar 40. The outer cylinder can be held in place by gripping the outer gripping groves 9 or if needed by use of a wench 32. A hexagonal shaped allen wrench 33 can be used to insert through the center opening of the collar 40 into the recess 45 to keep the fastener shaft 42 from turning as shown in FIG. 1. While holding the shaft 42 with the hexagonal wrench 33, the inner cylinder 2 is then torqued counter-wise using an open-end box wrench 32. This will force the inner cylinder 2 to move through the outer cylinder 3 forcing the collet 20 into the inner beveled portions 7 of the outer cylinder. The collet 20 continues to move within the beveled portion 7 until the collet completely closes upon the portion 47 of the collar, the inner teeth 23 impressing upon the collar 40 to prevent slippage. Further torqueing of the inner cylinder 2 will translate into a torque movement to the collar 40. Since shaft 42 of the fastener is securly held using the allen wrench 33, the collar 40 unthreads from the threated shaft portion 41 of the fastener until it is off. The shaft 42 with the collar 40 removed can then be easily removed from the parts 50 and 51.

Further optional features include a flexible cushion of protective material to cover the bottom rim 17 of the outer cylinder to reduce scratching of the parts 50 by the tool. The cushion prevents the bottom rim 17 from making direct contact with the part 50, if desired.

Also, flexural assisting groves aligned along the outer surface of the collet 20 (not shown) would enable the collet 20 to flex as it changes in diameter through the tapered section of the outer cylinder. This may assist in the movement of the collet 20 through the tapered portion of the outer cylinder to surround the collar 40, but not necessary.

While the above description contains many specifications, there should not be construed as limitations on the scope of the invention, but rather as an exemplification of one preferred embodiment thereof. Accordingly, the scope of the invention should be determined not by the embodiment illustrated, but by the appended claims and their legal equivalents.

What I claim is:

1. A locking collar removal tool for removing a frangible fastener; the fastener having a threaded locked collar on a near end of a threaded shaft with wrench receiving means, a retaining ring at a far end of the fastener, the tool comprising:

an outer cylinder having an outer gripping means, a threaded upper inner portion, a bottom inner tapered portion; the threaded upper inner portion counter threaded with respect to the locking direction of the collar to the shaft;

an inner cylinder having a torque receiving means, a flat bottom rim, a threaded outer portion grooved to interact with the threaded upper inner portion of the outer cylinder;

a collet with section removed to permit the collet to decrease in size and sized to surround said collar when open, the collet having a flat upper rim, an outer tapered bottom portion, the collet positioned within said outer cylinder below said inner cylinder urged through the inner tapered portion by the flat bottom rim of said inner cylinder thereby compressing the collar as the inner cylinder is torqued with respect to the outer cylinder in an opening direction.

2. A locked collar removal tool for removing a frangible fastener as described in claim 1 where the collet is made of a harden material having with memory.

3. A locked collar removal tool for removing a frangible fastener as described in claim 1 where the gripping means comprises a plurality of flexural assisting groves along the outer surface of said outer cylinder.

4. A locked collar removal tool for removing a frangible fastener as described in claim 1 where the outer gripping means comprises a plurality of outer faces to receive a wrench means.

5. A locked collar removal tool for removing a frangible fastener as described in claim 1 where the outer gripping means comprises a plurality of longitudinal indentations along the outer surface of said outer cylinder and a plurality of outer faces to receive a wrench means.

6. A locked collar removal tool for removing a frangible fastener as described in claim 1 where the torquing means comprises a plurality of outer faces to receive a wrench means.

7. A locked collar removal tool for removing a frangible fastener as described in claim 1 where the gripping means comprises a plurality of longitudinal indentations along the outer surface of said outer cylinder and a plurality of outer faces to receive a wrench means, the torquing means comprising a plurality of outer faces to receive a wrench means.

8. A locked collar removal tool for removing a frangible fastener as described in claim 1 where said collet has a plurality of inner oriented gripping teeth to interact with said collet.

9. The method of removing a frangible fastener having a threaded locked collar on a near end of a threaded shaft, a wrench receiving means at the near end, a retaining ring at a far end to hold a plurality of pieces together within said collar and retaining ring, the method comprising:

placing a collet having a portion removed to enable said collet to surround the collar, the collet set within an outer cylinder with a inner tapered bottom portion and an upper inner threaded portion, having a slope direction contrary to the closing direction of the locked collar to the threaded shaft, while gripping the outer cylinder, torquing an inner cylinder having thread slopes matching the slope of the upper inner threaded portion of the outer cylinder, a bottom rim of the inner cylinder urging the collet through the inner tapered bottom thereby closing the collet upon the collar transferring torque upon the collar to rotate the locked collar from the threaded shaft.

10. The method of removing a frangible fastener as described in claim 9 further gripping the threaded shaft when rotating said inner cylinder.

* * * * *